US006190082B1

(12) United States Patent
Butterfield

(10) Patent No.: US 6,190,082 B1
(45) Date of Patent: Feb. 20, 2001

(54) BABYGATE QUAD LOCK SYSTEM

(76) Inventor: Gary M. Butterfield, 132 Tomahawk Dr., Indian Harbour Beach, FL (US) 32937

( * ) Notice: Under 35 U.S.C. 154(b), the term of this patent shall be extended for 0 days.

(21) Appl. No.: 09/260,803

(22) Filed: Mar. 2, 1999

(51) Int. Cl.[7] ..... E04H 17/16

(52) U.S. Cl. ..... 403/325; 403/329; 403/347; 403/378; 256/26; 49/50

(58) Field of Search ..... 403/286, 329, 403/325, 347, 378, 379.5, 360, 108; 256/25, 26, 65, 31; 160/135; 49/50

(56) References Cited

U.S. PATENT DOCUMENTS 1,127,493 * 2/1915 Nagy ..... 256/26 X
3,164,351 * 1/1965 Rembowski ..... 403/108
4,193,377 * 3/1980 Weldy ..... 256/26 X
4,247,216 * 1/1981 Pansini ..... 403/324 X
4,645,183 * 2/1987 Rattray et al. ..... 256/25
4,687,076 * 8/1987 Tu ..... 403/325 X
5,060,631 * 10/1991 Lin ..... 160/135
5,240,230 * 8/1993 Dougherty ..... 256/65 X
5,881,789 * 3/1999 Melashenko et al. ..... 160/135

* cited by examiner

*Primary Examiner*—Lynne H. Browne
*Assistant Examiner*—David E. Bochna
(74) *Attorney, Agent, or Firm*—Reed Smith Hazel & Thomas LLP

(57) ABSTRACT

In an improved child security fence system or pool gate, pole adapters are used for locking together two panels of the fence or pool gate. The pole adaptors are inserted into the support poles of two adjacent fence panels. The two panels are then attached to one another by a lock that bridges the two pole adaptors. The pole adaptors and the lock all have holes drilled through them that align with each other when assembled. Tension clips are positioned inside each pole adaptor so that dimples or tabs extend from the clips and through the aligned holes. In order to disengage the lock, the dimples or tabs from the clips must be simultaneously depressed at four points of the locking assembly.

8 Claims, 1 Drawing Sheet

BABYGATE QUAD LOCK SYSTEM

BACKGROUND OF THE INVENTION

1. Field of the Invention

The present invention is directed to a system for locking together two panels of a fence or pool gate. Pole adapters are inserted into the support poles of two adjacent fence panels. The two panels are then attached to one another by a lock that bridges the two pole adapters.

2. Background of the Invention

With the popularity of private backyard swimming pools, spas and ponds has come the need for securely lockable child security fences or pool gates to prevent unattended children from entering the pool, spa or pond area and risking accidental falls into the water. Such security fences, while difficult for a child to open, should be well within the capacity of the average babysitter, parent or lifeguard to open for the overall enjoyment of the facility and, of course, in the event of an emergency.

Conventional pool enclosures have been fitted with standard latch mechanisms, including swing latches, push buttons, and spring action hinges, often supplemented by key locks. However, such conventional latching mechanisms lose effectiveness over time due to wear, weather beating, and the like, and become relatively easier for children to open, particularly as children age and grow taller. Reliance on key locks as a secondary or back-up latching means is disadvantageous in cases where emergency access to the pool, spa or pond area is necessary, not to mention the inconvenience associated with carrying a key or keys and the possible misplacement or loss of same.

Known fence panels and baby restraint gates used, independently of a fence system, to bar entry to or exit from an area which is substantially already enclosed by walls or the like, have associated with them the problem of secure attachment to existing support means.

U.S. Pat. 5,664,769 discloses a gate assembly for tensioned mesh fences, particularly those which encircle home swimming pools and are removable for swimming pool use. The gate is closed by a magnetic latch, and may be supplemented by a key lock.

U.S. Pat. 3,767,167 describes portable fence panels having a rod-like male member at an end thereof for connection to an identical panel by a temporary locking means having tubular female members. When two panels are to be joined together, the male members of adjacent panels are inserted into the female members of the locking means. This temporary lock may be reinforced by a bolt fastener.

Thus, the known systems rely for a secure latch or lock on a secondary or backup locking means such as a key or other fastener, such as a bolt fastener. There exists therefore a need for a lockable fence system which does not require a back-up lock and is readily secured against operation by children, but which remains easily opened or unlocked by a babysitter or adult supervisor.

SUMMARY OF THE INVENTION

This object is achieved by the present invention, which is directed toward an improved child security fence system or pool gate. The system of the invention uses pole adapters for locking together two panels of the fence or pool gate. The pole adaptors are inserted into the support poles of two adjacent fence panels. The two panels are then attached to one another by a lock that bridges the two pole adaptors. The pole adaptors and the lock all have holes drilled through them that align with each other when assembled. Tension clips are positioned inside each pole adaptor so that dimples or tabs extend from the clips and through the aligned holes. In order to disengage the lock, the dimples or tabs from the clips must be simultaneously depressed at four points of the locking assembly.

A series of fence panels may be connected in this manner to provide a secure fence enclosure around a pool or the like. One or more of the panels may be removed from the enclosure by disengaging the locks at each end of the panel to be removed. The secure fence enclosure may be permanent, semi-permanent or portable, depending upon the design of the fence panel body, such as materials chosen for the mesh and for the support structures, which may be conventional materials.

Another embodiment of the invention is the use of the lock bridge to secure the movable end of a swinging fence gate to the end post of the fence structure. The end post of the fence structure is fitted with a pole adapter, either at the point of manufacture or retrofitted. The end or support pole of the swinging fence gate is also so fitted. The gate lock bridge of the invention is then used as the primary gate lock or as a back-up to the traditional gate latch mechanisms.

The disengagement of the lock may be readily effected by a babysitter or by an adult supervisor, who would in most cases be taller than the height of the lock and would thus be in a better position to handle the simultaneous depression of the four dimples in order to disengage the lock. A child would in most cases be forced to reach up and over the top of the fence panel in order to grasp the lock and perform the simultaneous depression of dimples required to release the lock. Most younger children would also lack the strength and coordination required to disengage the lock.

Another embodiment of the present invention is the use of the pole adapter/lock assembly in blocking an opening in an existing fenced or walled structure, such as a doorway. This is effected by anchoring a short pole section having a pole adapter to the fence or to the wall itself on either side of the opening. A fence panel having two end poles with pole adaptors is then attached to each of the short pole sections at the pole adaptor by utilizing two lock bridges. The barrier at the fence or wall opening will be spaced a short distance from the existing fence or wall structure, but the space is not sufficient to permit the head or body of a child to move through or be caught in the space.

Moreover, even if a child possessed the coordination and strength required to open one of the two locks on such a fence panel, the four dimple locking arrangement on the other of the two locks would prevent the panel or gate from swinging in either an inward or outward direction, thus providing a secondary safety measure and/or additional time for the child's supervisor to prevent the child from passing through the barrier.

DETAILED DESCRIPTION OF THE PREFERRED EMBODIMENT

Figure 1:
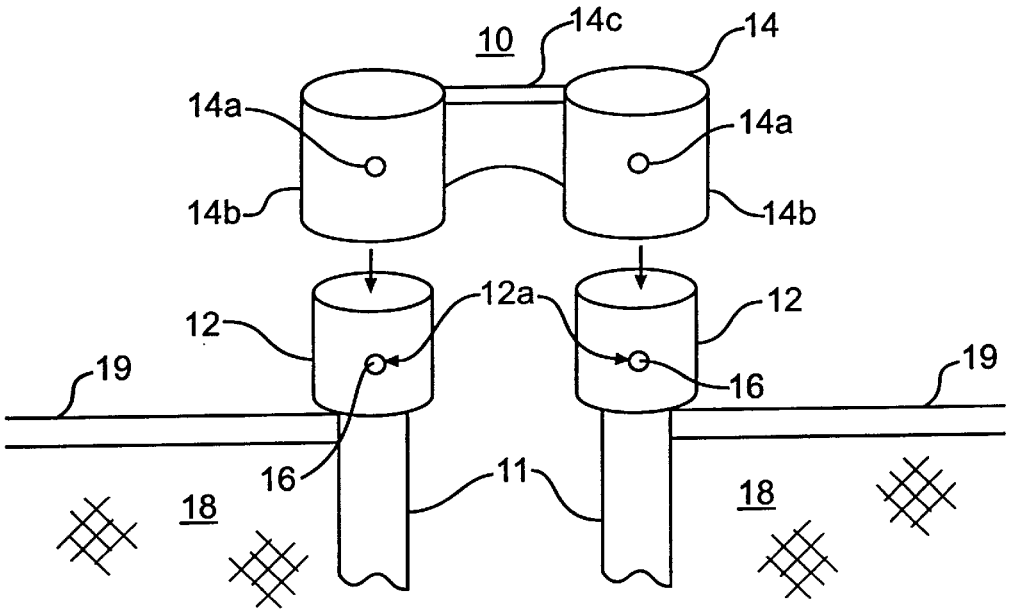
FIG. 1 illustrates a perspective view of the overall system of the present invention as applied to a fence.

The system 10 for locking together two panels 18 of a fence or pool gate by their fence posts or poles 11 is shown in FIG. 1. Each fence panel 18 comprises an upper horizontal support means 19, at least one end post or pole 11, and conventional fencing material attached to the horizontal support means 19 and the at least one post or pole 11.

Figure 2:
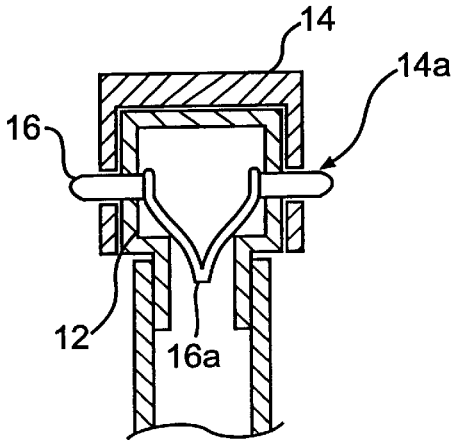
FIG. 2 shows an exploded diagram of the elements of the present invention.

The posts or poles 11 are fitted with substantially cylindrical pole adapter elements 12. Each pole adapter element 12 is provided with holes 12*a* aligned on the anterior and posterior sides of the adapter element 12. Each pole adapter element 12 houses two tension dimples 16 which protrude through the holes 12*a*. As shown in FIG. 2, tension dimples 16 are attached to the upper ends of substantially v-shaped locking spring 16*a*.

Returning to FIG. 1, lock 14 comprises substantially cylindrically-shaped cup members 14*b* attached at a spaced distance by a bridge member 14*c*. The length of the bridge member 14*c* corresponds to the space between adjacent fence posts or poles such that cup members 14*b* are positioned to slip over the pole adapter element 12 of each post or pole. Of course, the space between adjacent fence posts or poles, and thus the length of the bridge member 14*c*, is sufficiently small to preclude an infant's or toddler's head or body from passing through the space and potentially being caught therein, i.e. preferably less than four inches.

Each cup member 14*b* is provided with two holes 14*a* on the anterior and posterior sides of the cup member 14*b* such that holes 14*a* are in alignment with dimples 16 of each pole adapter element 12. Dimples 16 are depressed to permit cup-shaped members 14*b* to slide down over adjacent pole adapter elements 12 until holes 14*a* of lock 14 align with and engage dimples 16. The action of locking spring 16*a* forces the dimples 16 through holes 14*a*, thus creating four locks of the assembly.

In order to disengage the lock 14 from the pole adapter elements 12, all four dimples 16 must be simultaneously depressed to permit removal of lock 14 from the fence arrangement.

In one embodiment, pole adapter elements 12 are manufactured independently from the fence posts 11 and are configured to replace or fit over the tops of existing adjacent fence posts for secondary reinforcement purposes when lock 14 is engaged, such as, for example, in the case of a swinging lock. In another embodiment, pole adapter elements 12 are formed integrally with the poles 11 at the time of manufacture for increased durability of the system 10. This aspect of the invention is also advantageous in the case of portable systems.

The system 10, including poles 11, pole adapter elements 12 and lock 14 may be constructed of any conventional fencing material, such as metal, plastic, is fiberglass, or wood, which may be colored for a decorative effect. Preferably, however, the system 10 is manufactured with polycarbonate, most preferably, black polycarbonate with or without fiberglass reinforcement. Dimples 16 and locking spring 16*a* may be of conventional construction, but dimples 16 are preferably colored to match the color of the remainder of the system 10. The locking spring 16*a* itself may be of any conventional plastic or polypropylene type, such as a coil spring, so long as it is constructed to urge the dimples 16 outward and into their respective holes.

The poles 11 of the system 10 may be manufactured at different lengths to accommodate use of the system on hilly terrain or on pool deck steps or stairwells such that the tops of adjacent poles 11 are at the same height for connection by the lock 14. Alternatively, extensions (not shown) may be attached to the bottom portion of a pole 11 to bring its top portion containing the pole adapter 12 in line with the pole adapter 12 of the neighboring pole 11.

Figure 3:
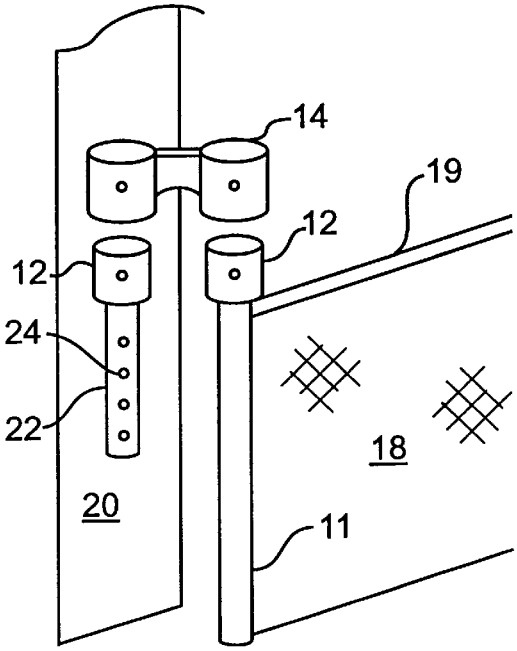
FIG. 3 shows a perspective view of an alternate embodiment of the invention.

FIG. 3 shows an alternative embodiment of the invention wherein the system of the invention is adapted for use in connection with an existing fence or wall structure 20 in order to block an opening or passageway (not shown) through said structure, such as a doorway, gateway, hallway, or entranceway. In this embodiment, an adapter pole 22 is attached to the existing fence or wall structure 20 on either side of the passageway via pole locking elements 24. Each adapter pole 22 is placed on the fence or wall structure 20 at a distance from the opening therein which is selected to permit the end poles 11 of the fence panel 18 to align with the poles 22 when the system is in use, as more fully discussed below.

Pole locking elements 24 are each of the same size and shape such that the adapter pole 22 is maintained at a distance from the structure 20 which is consistent along the length of the adapter pole 22. Each adapter pole 22 is of sufficient length to provide support for the panel 18 to be attached thereto, and may range from about eight inches to about the height of the fence panel 18 to be used, i.e. about three to four feet. The pole locking elements 24 may be any conventional attachment means. For example, if the structure 20 is a brick wall, the locking elements 24 may be comprised of mortar stakes, building spikes, or the like. If the structure 20 is a mesh or link fence, the elements 24 may be loops, wires, or the like which are threaded through the mesh or links. Likewise, if the structure 20 is a wooden wall or fence, conventional nails, screws, or the like may be used as the locking elements 24.

Each adapter pole 22 is fitted with a pole adapter element 12 as described hereinbefore. A fence panel 18 having two end posts 11 is then placed in front of the passageway such that each end post 11 is in direct alignment with each adapter pole 22. A lock 14 is then slipped over the pole adapter elements 12 of each corresponding adapter pole/end post pair to lock the fence panel 18 in place and block entry and exit through the passageway.

This embodiment of the invention may alternatively be configured such that the adapter poles 22 are mounted on opposing wall surfaces of a passageway or hallway and the fence panel 18 is inserted between the mounted adapter poles 22. The fence panel 18 is then secured as described above with reference to FIG. 1.

Although the present invention has been fully described in connection with the preferred embodiment thereof with reference to the accompanying drawings, it is to be noted that various changes and modifications are apparent to those skilled in the art. For example, while the lock is hereinabove described as having substantially cylindrical cup-shaped members, it would be a simple design choice to select any workable geometric configuration for the members. Such changes and modifications are to be understood as included within the scope of the present invention as defined by the appended claims, unless they depart therefrom.

What is claimed is:

1. A system for securely locking together at least first and second adjacent fence panels, the first and second fence panels having adjacent end posts, said system comprising:

first and second adapters fixedly connected to a top end of each adjacent end post;

a lock element having first and second cup members fixedly connected to each other via a bridge member, said first and second cup members being formed to slidably fit over said first and second adapters when the first and second fence panels are aligned with each other so as to fixedly maintain the first and second panels in alignment with each other; and first and second resilient locking elements operatively mounted within said first and second adapters, respectively, so as to resiliently lock said first and second adapters with said first and second cup members, respectively.

2. A system according to claim 1, wherein said first and second adapters each has defined thereon locking holes on anterior and posterior sides thereof, said first and second cup members each has defined thereon locking holes on anterior and posterior sides thereof and located so as to align with the locking holes of corresponding ones of said first and second adapters when said first and second cup members are fitted thereover, and said first and second resilient locking elements each includes a spring element with anterior and posterior dimple elements formed thereon, said first and second locking elements being positioned such that the anterior and posterior dimple elements are urgingly fitted into corresponding locking holes of said first and second adapters and corresponding holes of said first and second cup members that are aligned therewith.

3. A system for securely locking together at least first and second adjacent fence panels, the first and second fence panels having adjacent end posts, said system comprising:

first and second adapters integrally formed within a top end of each adjacent end post;

a lock element having first and second cup members fixedly connected to each other via a bridge member, said first and second cup members being formed to slidably fit over said first and second adapters when the first and second fence panels are aligned with each other so as to fixedly maintain the first and second panels in alignment with each other; and first and second resilient locking elements operatively mounted within said first and second adapters, respectively, so as to resiliently lock said first and second adapters with said first and second cup members, respectively.

4. A system according to claim 3, wherein said first and second adapters each has defined thereon locking holes on anterior and posterior sides thereof, said first and second cup members each has defined thereon locking holes on anterior and posterior sides thereof and located so as to align with the locking holes of corresponding ones of said first and second adapters when said first and second cup members are fitted thereover, and said first and second resilient locking elements each includes a spring element with anterior and posterior dimple elements formed thereon, said first and second locking elements being positioned such that the anterior and posterior dimple elements are urgingly fitted into corresponding locking holes of said first and second adapters and corresponding holes of said first and second cup members that are aligned therewith.

5. A system for securely locking a fence gate that includes a gate panel and an adjacent fence panel, the gate panel and fence panel having adjacent end posts, said system comprising:

first and second adapters fixedly connected to a top end of each adjacent end post;

a lock element having first and second cup members fixedly connected to each other via a bridge member, said first and second cup members being formed to slidably fit over said first and second adapters when the first and second fence panels are aligned with each other so as to fixedly maintain the first and second panels in alignment with each other; and first and second resilient locking elements operatively mounted within said first and second adapters, respectively, so as to resiliently lock said first and second adapters with said first and second cup members, respectively.

6. A system according to claim 5, wherein said first and second adapters each has defined thereon locking holes on anterior and posterior sides thereof, said first and second cup members each has defined thereon locking holes on anterior and posterior sides thereof and located so as to align with the locking holes of corresponding ones of said first and second adapters when said first and second cup members are fitted thereover, and said first and second resilient locking elements each includes a spring element with anterior and posterior dimple elements formed thereon, said first and second locking elements being positioned such that the anterior and posterior dimple elements are urgingly fitted into corresponding locking holes of said first and second adapters and corresponding holes of said first and second cup members that are aligned therewith.

7. A system for blocking an opening in a wall or fence structure, said system comprising:

first and second adapter poles fixedly connected to each side of the opening, each including an adapter element at the top end thereof;

a portable fence panel having first and second end posts, each including an adapter element at the top end thereof, the fence panel being positioned such that the adapter element of the first end post aligns with the adapter element of the first adapter pole and the adapter element of the second end post aligns with the adapter element of the second adapter pole;

two locking elements, each having first and second cup members fixedly connected to each other via a bridge member, said first and second cup members being formed to slidably fit over said aligned adapter elements at each side of the opening so as to fixedly maintain the fence panel in front of the opening; and resilient locking elements operatively mounted within each of said adapter elements, so as to resiliently lock said aligned adapter elements with said first and second cup members of each of said locking elements.

8. A system according to claim 7, wherein said adapter elements each has defined thereon locking holes on anterior and posterior sides thereof, said first and second cup members each has defined thereon locking holes on anterior and posterior sides thereof and located so as to align with the locking holes of corresponding ones of aligned adapter elements when said first and second cup members are fitted thereover, and said resilient locking elements each includes a spring element with anterior and posterior dimple elements formed thereon, said locking elements being positioned such that the anterior and posterior dimple elements are urgingly fitted into corresponding locking holes of said aligned adapter elements and corresponding holes of said first and second cup members that are aligned therewith.

* * * * *